US005285596A

United States Patent [19]

Kinsey

[11] Patent Number: 5,285,596

[45] Date of Patent: Feb. 15, 1994

[54] DOOR CLOSURE APPARATUS

[76] Inventor: Kenneth M. Kinsey, 2859 E. Impala Ave., Mesa, Ariz. 85204

[21] Appl. No.: 975,881

[22] Filed: Nov. 13, 1992

[51] Int. Cl.[5] ..... E05D 15/06; E05F 1/00

[52] U.S. Cl. ..... 49/404; 16/81; 49/450

[58] Field of Search ..... 49/404, 449, 450; 16/81; 292/DIG. 46

[56] References Cited

U.S. PATENT DOCUMENTS

| | | | |
|---|---|---|---|
| 516,802 | 3/1894 | Eddy | 16/81 |
| 3,274,733 | 9/1966 | Bailey | 16/81 X |
| 3,334,444 | 8/1967 | Hargrove | 49/404 |
| 4,263,795 | 4/1981 | Van Gompel | 49/450 X |
| 4,649,598 | 3/1987 | Kinsey et al. | 49/404 X |
| 4,884,369 | 12/1989 | Tatham | 49/404 |
| 4,891,911 | 1/1990 | Yung | 49/404 |
| 5,131,188 | 7/1992 | Hutchison et al. | 49/404 |

*Primary Examiner*—Philip C. Kannan
*Attorney, Agent, or Firm*—Tod R. Nissle

[57] ABSTRACT

A closure device automatically closes a sliding door and latches the door to prevent children from opening the door once it has been closed.

9 Claims, 5 Drawing Sheets

FIG. 9
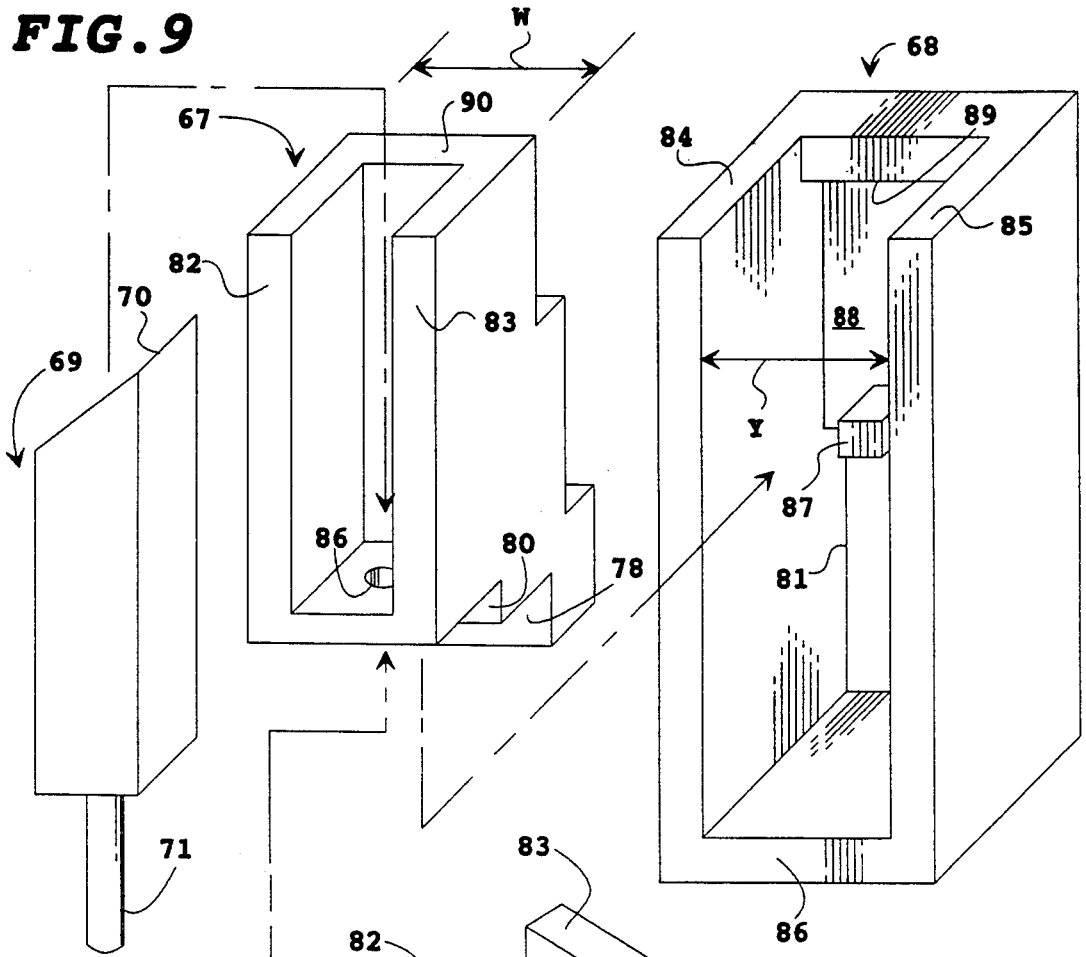
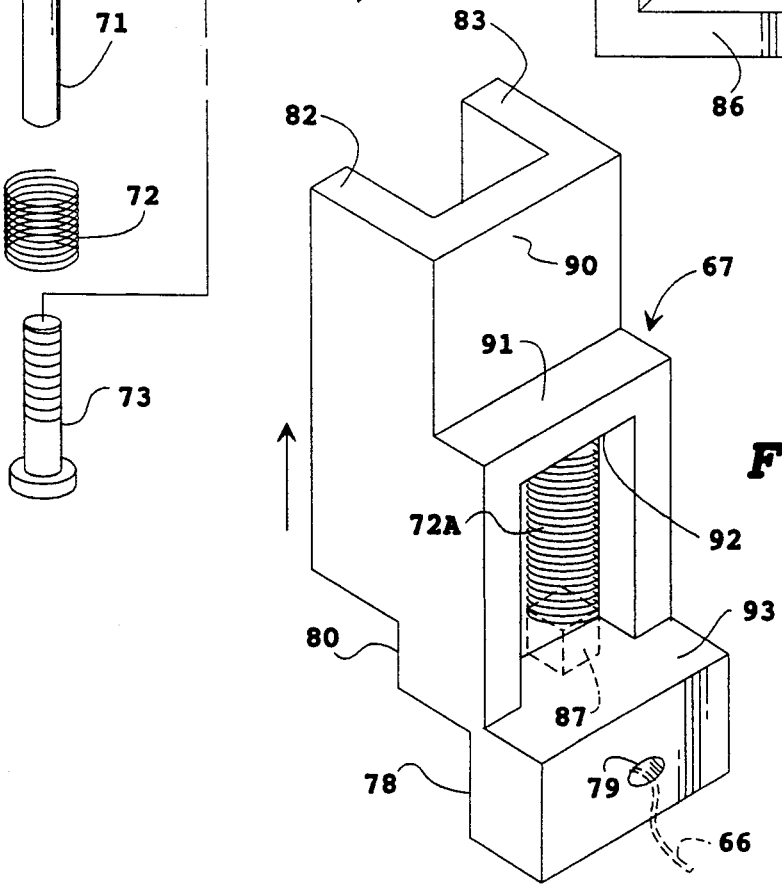
FIG. 10

DOOR CLOSURE APPARATUS

This invention relates to a closure device for use in closing doors and windows.

More particularly, the invention relates to a closure device which automatically closes a sliding door and latches the door to prevent children from opening the door once the door has been closed.

In a further respect, the invention relates to a closure device of the type described which is adapted to provide the force necessary to overcome the inertia of and move a heavy sliding door to a closed position after the door has been opened, Door closure systems for sliding doors and hinged doors are well known in the art. See, for example, U.S. Pat. Nos. 4,649,598 to Kinsey et al. and 4,884,369 to Tatham. The sliding door closure systems described in the Kinsey et al. and Tatham patents each utilize a weight carried on one end of a cable which extends upwardly over a pulley. The other end of the cable is fixedly attached to the door header at a location which is approximately centered over the sliding door when the door is closed. The pulley is fixedly secured to an upper corner of the door such that the weight hangs behind the sliding door, i.e., hangs behind the side of the door which is spaced away from the side of the door which contacts and closes against one vertically oriented side of the frame housing the sliding door. The portion of the cable extending from the weight up to the pulley is vertically oriented. The portion of the cable extending from the pulley to the point at which the cable is attached to the door header is horizontally oriented. When the sliding door is opened, the pulley is laterally displaced, the length of the vertically oriented portion of the cable is shortened, the cable upwardly lifts the weight, and the force of gravity acting on the weight presses the cable against the pulley and generates a horizontally oriented displacement force against the pulley which tends to cause the door to close.

The sliding door closure systems described in the Kinsey et al. and Tatham patents suffer from two disadvantages. First, when the systems are utilized on heavy sliding doors, the displacement force which is generated against the pulley is not sufficient to overcome the inertia and frictional forces associated with the door and to cause the door to close unless an unusually heavy weight is used. The size and space occupied by such a heavy weight tend to make the closure system impractical or unsightly. Second, the latching system used to secure a sliding doors in the closed position requires precision installation and, even when the latching system is carefully installed, tends to wear and break.

Accordingly, it would be highly desirable to provide an improved door closure system for a sliding door which would close heavy sliding doors and which would securely latch the sliding door in the closed position.

Therefore, it is a principal object of the invention to provide an improved closure system for sliding doors and hinged doors.

A further object of the invention is to provide an improved closure system for a sliding door which would cause the door to close even when the door was unusually heavy.

Another object of the invention is to provide an improved closure system for a sliding door which would repeatedly and reliably latch a sliding door in the closed position.

Still a further object of the invention is to provide an improved closure system for a sliding door which would occupy a minimal amount of space when installed on the door.

These and other, further and more specific objects and advantages of the invention will be apparent to those skilled in the art from the following detailed description thereof, taken in conjunction with the drawings, in which:

FIG. 9 is an exploded assembly view illustrating the housing and tracking tooth of the latching apparatus of FIGS. 7 and 8; and, FIG. 10 is a perspective view illustrating a housing member in the latching apparatus of FIGS. 7 to 9.

Briefly, in accordance with my invention, I provide an improved closing device for a door. The device includes a vertically oriented hollow tube; a weight disposed in the tube for movement therealong; a seal connected to the weight for sealing the exterior of the weight and the interior of the housing; port means at the bottom of the tube to permit air to flow in or out of the tube below the weight; a pulley attached to the top of the tube; a cable attached to the top of the weight and extending over the pulley and attached to a selected point on the door header; and, spring means mounted inside the top of the tube to be compressed by the weight when the weight moves upwardly toward the top of the tube.

In accordance with another embodiment of the invention, I provide a latch device for a door. The latch device includes an elongate rack of downwardly projecting teeth attached to a selected point on the door header, each tooth including a sloped planar surface and a vertically oriented surface co-terminating at the tip of the tooth; a housing attached to the top of the door; a tracking tooth slidably mounted in the housing and including a tracking tip; and, biasing means mounted in the housing for upwardly urging the tracking tooth toward the door header such that the tracking tooth slides over at least a portion of the sloped planar surface and over the tip of at least one of the rack teeth when the door is being closed in a first direction of travel such that the tracking tip of the tracking tooth is prevented by the vertically oriented surface of said one of the rack teeth from moving in a direction opposite the first direction of travel after the door is closed.

Figure 1:
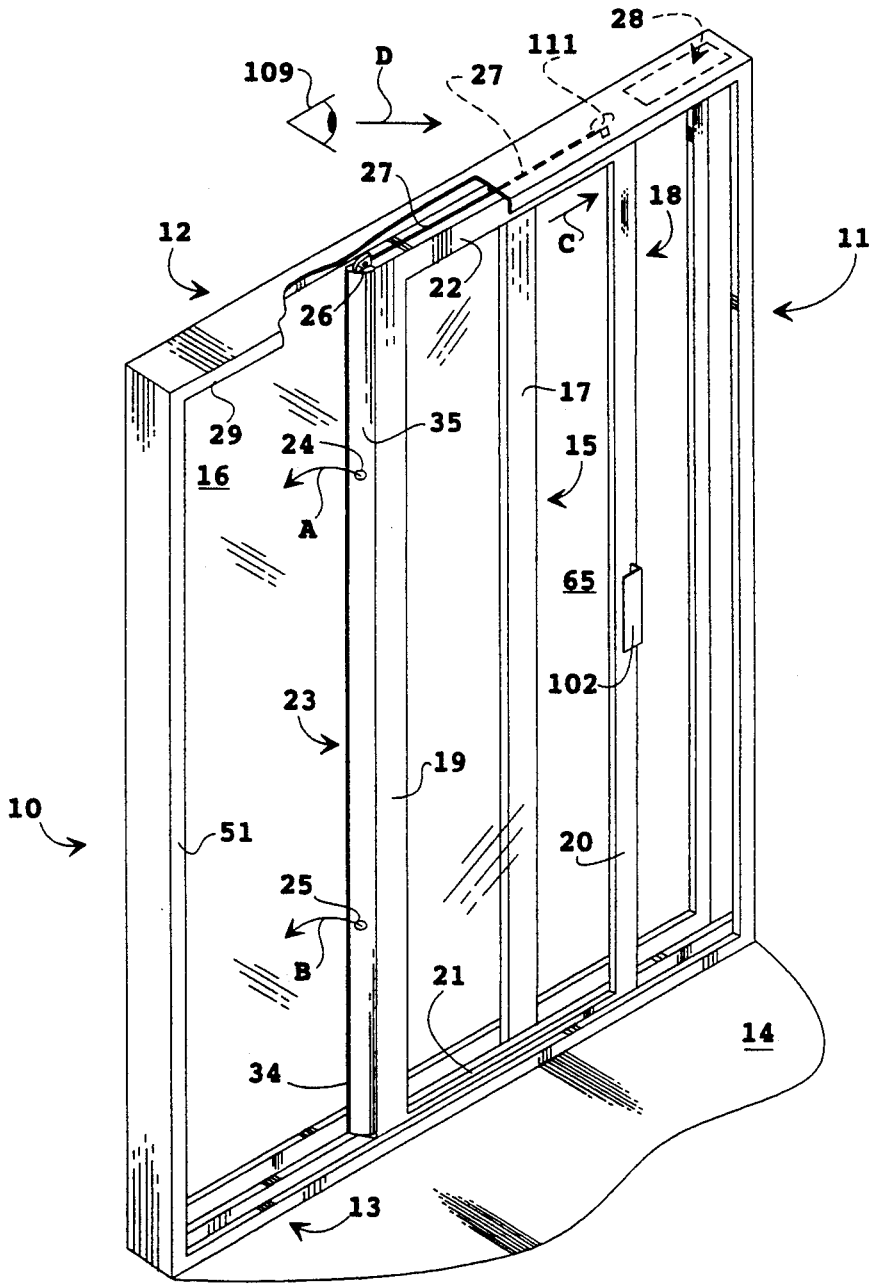
FIG. 1 is a perspective view illustrating a sliding door equipped with a closure system constructed in accordance with the principals of the invention.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a sliding door assembly including a rectangular frame having sides 10 and 11, bottom 13 and top or door header 12. The frame is anchored in the vertical wall (not shown) of a residence or other structure. Bottom 13 is fixedly attached to floor 14. Door 15 is fixedly secured in the rectangular frame and includes rectangular glass pane 16 attached along a vertical edge to fixed panel member 17. Sliding door 18 includes rectangular panel 65 mounted in a rectangular frame including side panel members 19 and 20, top panel member 22, and bottom panel member 21. Handle 102 is attached to panel member 20.

Figure 3:
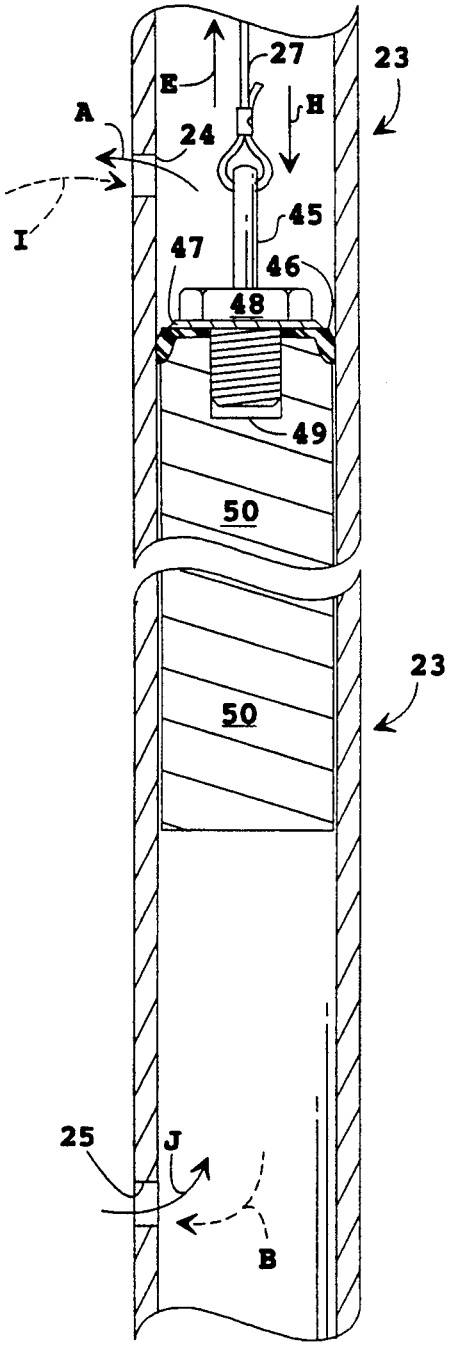
FIG. 3 is a partial section view of the closure system of FIG. 1 and illustrating further internal construction details thereof.

The door closing device of the invention includes vertically oriented elongate cylindrical hollow tube 23 fixedly attached to panel member 19. Pulley unit 26 is fixedly attached to the top of tube 23. One end of cable 27 is fixedly anchored to door header 12 by a rivet 111, bolt, or other means. The other end of cable 27 is, as illustrated in FIG. 3, attached to pin 45. Cable 27 extends from pin 45, over pulley wheel 30 to the bolt or other means fixedly anchoring cable 27 to header 12. Pin 45 is attached to bolt 48 which is turned into internally threaded aperture 49 formed in cylindrical weight 50. Washer 47 is interposed between the head of bolt 48 and circular resilient seal 46. Seal 46 prevents air from passing intermediate seal 46 and tube 23 when weight 50 moves up or down in tube 23.

Figure 2:
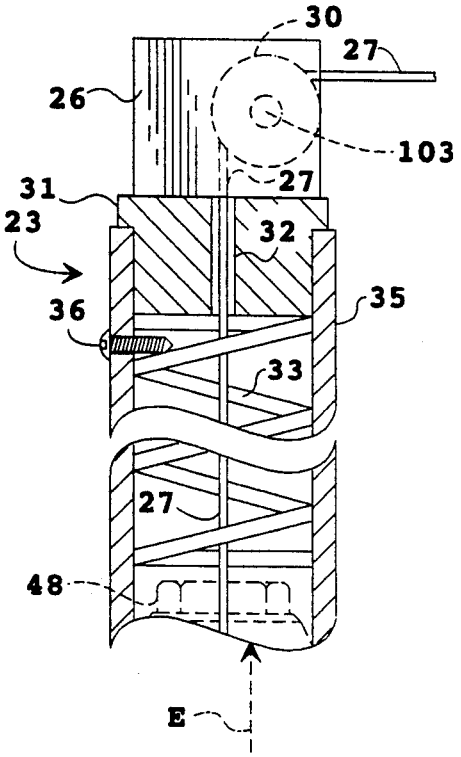
FIG. 2 is a partial section view of the closure system illustrated in FIG. 1 showing internal construction details thereof.

As illustrated in FIG. 2, pulley unit 26 includes a pulley wheel 30 which is pivotally mounted on and free wheels about an axle 103. Ball bearings are preferably interposed between wheel 30 and axle 103 to facilitate the ready turning of wheel 30 on axle 103. Cable 27 extends over wheel 30. Pulley unit 26 is fixedly attached to cylindrical plug 31 which is fixedly secured to the top 35 of tube 23. Cable 27 extends through cylindrical aperture 32 formed through plug 31. Spring 33 is maintained in the top 35 of tube 23. When cable 27 and weight 50 are upwardly displaced in the direction of arrow E when sliding door 18 is opened and moved in a direction of travel opposite the direction of travel indicated by arrow C in FIG. 1, bolt 48 contacts and compresses spring 33. When spring 33 is compressed, spring 33 generates a supplemental displacement force which, along with the force of gravity, displaces weight 50 downwardly in the direction of arrow H to cause door 18 to move in the direction of arrow C and to close. Weight 50 is downwardly displaced in the direction of arrow H by the force of gravity and spring 33 after door 18 is opened and is stationary.

Figure 4:
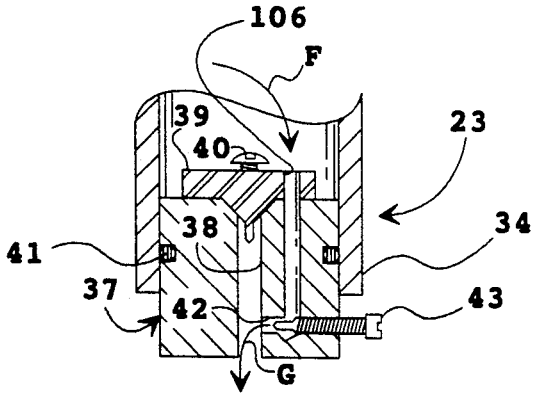
FIG. 4 is a partial section of the closure system of FIG. 1 illustrating the venting system at the bottom of the tube housing used in the system.
Figure 5:
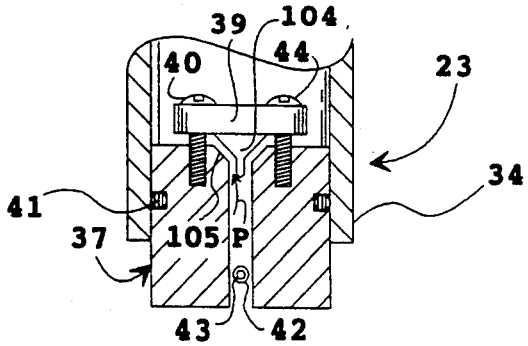
FIG. 5 is a partial section view of the venting system of FIG. 4.
Figure 6:
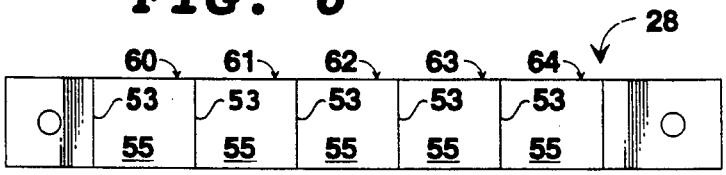
FIG. 6 is a top view illustrating a toothed rack used in the latching apparatus used in the closure system of the invention.

FIGS. 4 and 5 illustrate an air flow control mechanism for the lower end of tube 23. Plug 37 is fixedly secured in the lower end 34 of tube 23. 0-ring seal 41 seals plug 37 in tube 23. Central cylindrical passage 38 and L-shaped passage 42 are formed in plug 37. Set screw 43 is used to restrict the cross sectional area of passage 42. Cap 39 is provided with conical valve 104 which is contoured to fit conical opening 105. FIG. 4 shows the valve 104 closed and FIG. 5 shows the valve 104 opened. The valve 104 on cap 39 is held in position by screws 40 and 44 which permit the valve to move up and down. Passage 106 through cap 39 is aligned with passage 42 so that cap 39 will not restrict air flow. When the weight 50 is moved upwardly, that is when the door 18 is being opened, then valve 104 is opened to permit the air to rush in the direction indicated by arrow P so that the door can be opened rather quickly. Similarly, air rushes out vent hole 24 in the direction indicated by arrow A and, when weight 50 is above vent hole 25 moving upwardly away from the floor 14, air flows through vent hole 25 in the direction of arrow J. When the door 18 is moving in the direction of arrow C and is being closed, then valve 104 is closed so that air can only escape out through aperture 42 in the manner indicated by arrows F and G in FIG. 4. When door 18 is being closed, air also, when seal 46 is above vent hole 25, rushes out hole 25 in the manner indicated by arrow B in FIG. 3. Similarly, when weight 50 descends toward the floor 14 in the direction of arrow H and seal 46 is beneath vent hole 24, air can flow into tube 23 through vent hole 24 in the direction indicated by arrow I in FIG. 3. Vent hole 25 is positioned and weight 50 is sized such that seal 46 downwardly passes hole 25 before weight 50 can contact screws 40 and 44. As soon as seal 46 downwardly falls past hole 25, air can only escape from tube 23 through aperture 42. Aperture 42 is sized and screw 43 is positioned such that the flow of air through aperture 42 slows the descent of weight 50 and slows the rate at which door 18 moves in the direction of arrow C. Screw 43 can be adjusted to restrict the flow of air through aperture 42 such that door 18 moves very slowly when member 18 approaches side 11 and seal 46 is positioned beneath vent hole 25 and moving downwardly toward plug 37.

In the presently preferred embodiment of the invention, seal 46 is positioned in tube 23 above vent hole 24 when door 18 is completely opened and seal 46 is positioned in tube 23 beneath vent hole 25 when door 18 is completely closed.

Figure 7:
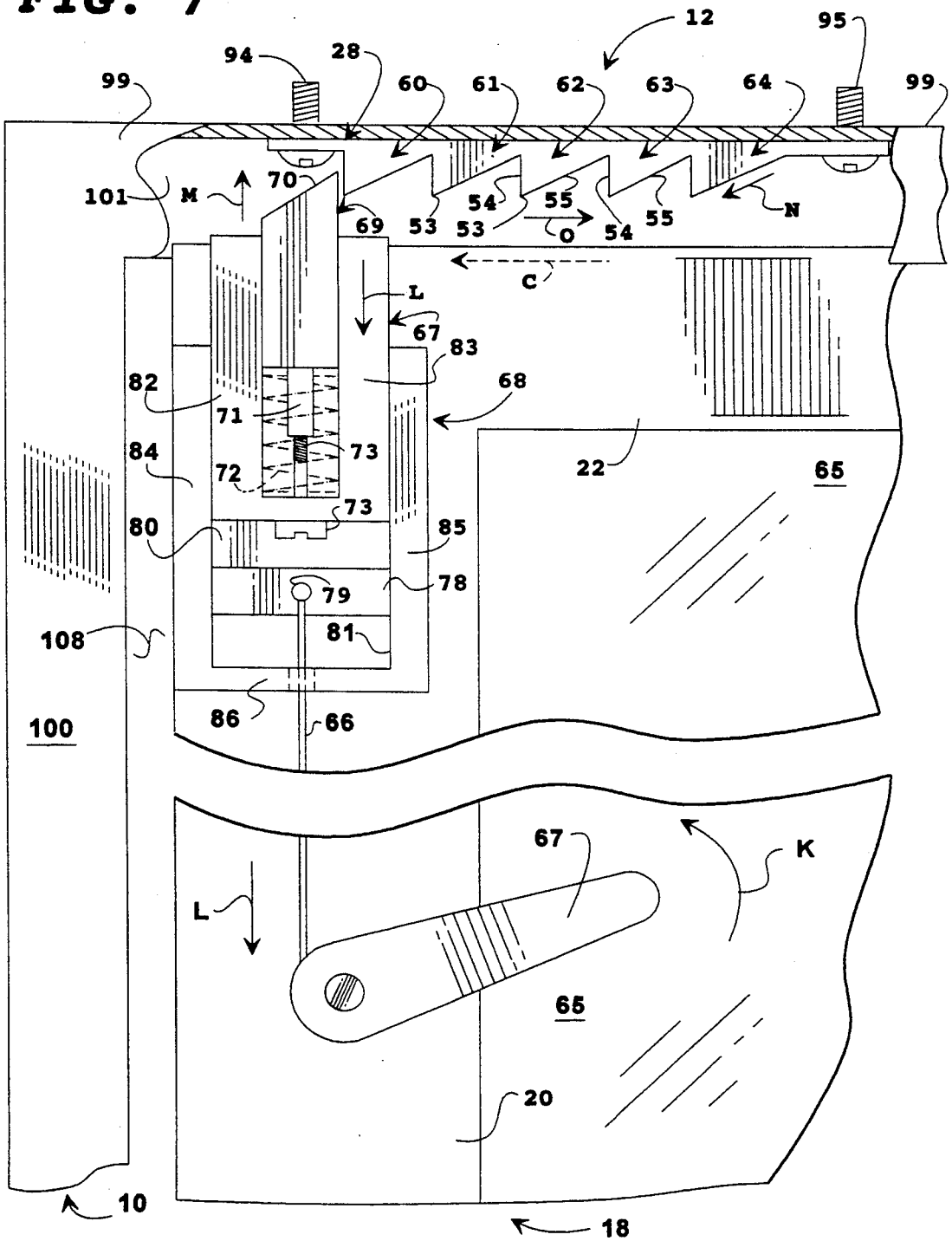
FIG. 7 is an elevation view illustrating latching apparatus used to maintain a sliding door in the closed position in the closure system of the invention.

FIGS. 6 to 10 illustrate a door latching device constructed in accordance with the principles of the invention. FIG. 7 represents a rear view of door 18 with the eye 109 of the viewer looking from behind the door 18 in FIG. 1 in the direction indicated by arrow D in FIG. 1. The latching device of FIG. 7 is not visible in FIG. 1 because it is on the other, or back, side of door 18. In FIG. 7, the door 18 is depicted as not being fully closed and there is a space 108 between side 20 member of door 18 and side 10 of the rectangular frame which houses door 18. The door latching device of FIG. 7 is normally constructed, configured, and positioned on door 18 and the frame which houses door 18 such that door 18 completely closes and side member 20 contacts side 10. On occasion, it may, however, be desired to configure the door latching device such that a space 108 exists when door 18 has reached its furthest point of travel in the direction of arrow C. Also, in FIG. 7, weight 50 may move the door 18 from the position shown and in the direction of arrow C to force door 18 completely closed such that side member 20 contacts side 10 and the tracking tip 70 of tooth 69 is spaced apart from and (in FIG. 7) to the left of vertical surface 54 of tooth 60.

The latching device of FIG. 7 includes a rack 28 of teeth 60, 61, 62, 63, 64. Each tooth 60 to 64 includes a vertically oriented surface 54 and sloped planar surface 55 which co-terminate along a horizontally oriented edge or tip 53. Rack 28 is secured to header 12 by a pair of screws 94 and 95. Rack 28 can be secured to header 12 at any desired location, but is preferably secured at a location which, when door 18 is closed and sides 20 and 10 contact one another, causes tracking tip 70 of tooth 69 to contact surface 54 of tooth 60.

Tracking tooth 69 is mounted in a housing which includes members 67 and 68. Tooth 69 includes tracking tip 70 and internally threaded cylindrical member 71. Externally threaded fastener 73 is inserted through aperture 86 in member 67 and is turned into member 71 to displace tooth 69 in the direction of arrow L toward aperture 86 and to compress spring 72 intermediate tooth 69 and aperture 86. Spring 72 is, for purposes of clarity, shown in ghost outline in FIG. 7. The upper end of cable 66 is fastened to member 67 through aperture 79. The lower end of cable 66 is attached to handle 67. Handle 67 is pivotally attached to side 20 member of door 18. Cable 66 extends from handle 67 upwardly through an aperture formed in the base 86 of member 68 (FIG. 7).

Member 68 is fixedly attached with bolts (not shown) or other means to the top of the back of side member 20 in the position shown in FIG. 7. Member 67 is slidably received by member 68 in the manner described below. Member 67 includes sides 82 and 83, back wall 90, front horizontally oriented parallel surfaces 80 and 78, and rear horizontally oriented parallel surfaces 91, 92, and 93. Member 67 includes vertically oriented side walls 84 and 85, vertically oriented back surface 88, and cube-shaped member 87 fixedly secured to surface 88 near the bottom of surface 88. Rectangular opening 81 extends between base 86 and the bottom of surface 88. The outer width, indicated by arrows W in FIG. 9, of member 67 is slightly less than the inner width, indicated by arrows Y in FIG. 9, of member 68 such that member 67 can be slidably inserted in member 68 between walls 84 and 85. When member 67 is inserted in member 68 in the manner illustrated in FIGS. 7, 8, and 9, a spring 72A is inserted between cube member 87 and the lower surface 92 of member 67 in the manner illustrated in FIG. 10. Further, when member 67 is inserted in member 68 with spring 67 positioned as shown in FIG. 10, surface 91 normally is parallel to and contacts horizontally oriented planar surface 89 of member 68. Spring 72A forces surface 91 upwardly against surface 89. Surface 89 is perpendicular to vertically oriented surface 88 of member 68. Although not shown in FIGS. 7, a rectangular plate 110 (FIG. 8) is normally fixedly attached to walls 84 and 85 in FIG. 7 to retain member 67 in position in member 68.

In operation of the latching device of FIG. 7, handle 67 is rotated in the direction of arrow K. When handle 67 is rotated in the direction of arrow K, cable 66 is displaced in the direction of arrow L. When cable 66 is displaced in the direction of arrow L, cable 66 downwardly slidably pulls member 67 in member 68 in the direction of arrow L and the tracking tip 70 of tooth 69 is displaced in the direction of arrow L so that tip 70 is moved to a position beneath and spaced apart from tip 53 of tooth 60 and door 18 can be opened in the direction of arrow O in FIG. 7. When member 67 is downwardly displaced in the direction of arrow L, surface 92 moves toward cube member 87, further compressing spring 72 between member 87 and surface 92. Handle 67 is held and tooth 69 maintained in position at a lower elevation than the tips 53 of teeth 60 to 64 while door 18 is slid to an open position. Once door 18 is open, handle 67 is released. After handle 67 is released, spring 72A expands, causing member 67 to slidably move in stationary member 68 in the direction of arrow M until surface 91 contacts surface 89 and tooth 69 returns to the vertical position shown in FIG. 7. After handle 67 is released weight 50 automatically causes door 18 to move in the direction of arrow C and close. When weight 50 causes door 18 to close in the direction of arrow C, tracking tip 70 of tooth 69 first contacts sloped surface 55 of tooth 64. Tip 70 slides over surface 64 and tooth 69 is displaced in the direction of arrow L while the door 18 continues to move in the direction of arrow C. When tooth 69 is displaced in the direction of arrow L, spring 72 is further compressed. Shortly after tip 70 bypasses tip 53 of tooth 64, spring 72 displaces tooth 69 in the direction of arrow M, and tip 70 is upwardly displaced adjacent surface 54 of tooth 64 until tip 70 contacts the sloped surface 55 of tooth 63. While door 18 continues to move in the direction of arrow C, tip 70 traverses the sloped surface 55 and tip 53 of each subsequent successive tooth 63, 62, 61, and 60 in a similar manner until tooth 69 reaches the position illustrated in FIG. 7. As earlier noted, after door 18 reaches the position shown in FIG. 7, weight 50 may cause door 18 to continue moving in the direction of arrow C and to completely close such that side member 20 contacts side 10.

One important advantage of the latching system of FIG. 7 is that even when door 18 does not quite close, tip 70 engages the surface 54 of one of teeth 60 to 64 and prevents door 18 from being opened again unless handle 67 is turned in the direction of arrow K to downwardly displace tip 70 to a position beneath the tips 53 of teeth 60 to 64. This reduces the likelihood that a young child will be able to open door 18 when door 18 does not quite completely close. Toward this end, handle 67 is normally positioned on side 20 at a position which is at least four or five feet above the floor 14, making it difficult for young children to reach handle 67. It is also preferable, but not necessary, that in operation handle 67 need to be turned in the direct of arrow K to downwardly displace tooth 69. The direction of arrow K is opposite the direction in which most similar door handles are turned to be operated, making it more difficult for a child to operate handle 67.

Figure 8:
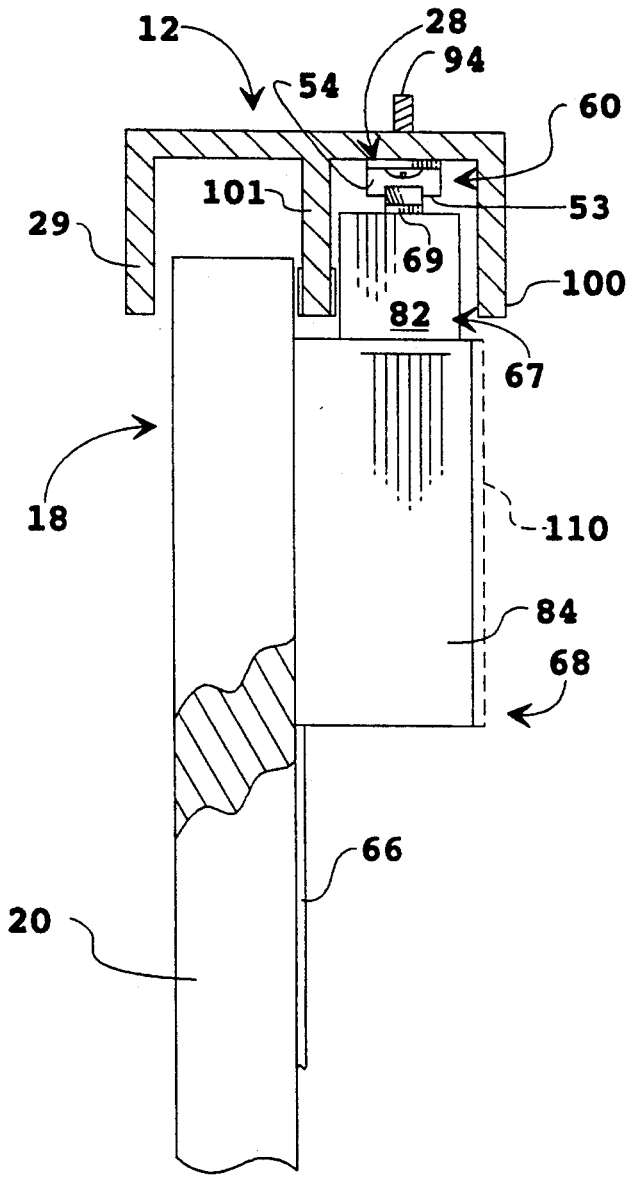
FIG. 8 is a side elevation view illustrating the latching apparatus of FIG. 7.

FIG. 8 is a side section view of the apparatus of FIG. 7 illustrating the dual U-shaped grooves formed in header 12 by elongate parallel spaced apart panel members 29, 100, and 101.

In operation of the door closure system of FIGS. 1 to 10, handle 67 is grasped and turned in the direction of arrow K to downwardly displace tooth 69 from the position illustrated in FIG. 7. After tooth 69 is downwardly displaced to a position which is beneath tip 53 of tooth 60, handle 67 or a door handle 102 is used to displace door 18 in the direction of arrow O. When door 18 is opened in the direction of arrow O in FIG. 7, cable 27 pulls weight 50 upwardly in the direction of arrow E in FIG. 3. When weight 50 moves upwardly, air is displaced out of vent holes 24 and 25 in the directions indicated by arrows A and B until seal 46 bypasses a vent hole 24 and 25. After seal 46 bypasses a vent hole 24 or 25 in the direction of arrow E and is above the vent hole, air is drawn into the vent hole in the direction indicated by arrows I and J in FIG. 3. As weight 50 continues to move upwardly in the direction of arrow E, bolt 48 contacts and compresses spring 33. After bolt 48 contacts and compresses spring 33, handle 67 (or 102) is released and the force of gravity and the downward force generated by spring 33 against bolt 48 generates a lateral force against wheel 30 which overcomes the inertia of door 18, causes door 18 to slide in the direction of arrow C, and causes weight 50 to move downwardly in tube 23 in the direction of arrow H. When weight 50 moves downwardly through tube 23, air escapes outwardly through each vent hole 24 and 25 in the direction of arrows A and B as long as seal 46 is positioned above the vent hole. After downwardly moving circular seal 46 bypasses a vent hole 24, 25, air begins to flow through the vent hole in the direction of travel indicated by arrows I and J, respectively, in FIG. 3. After downwardly moving circular seal 46 slides along tube 23 past vent hole 25, air can only escape from beneath weight 50 by passing through aperture 42. Aperture 42 is sized and set screw 43 normally is adjusted to restrict the flow of air and slow the downward descent of weight 50 and slow the lateral displacement of door 18 in the direction of arrow C in FIG. 7 as side member 20 approaches side 10. When the side member 20 begins to approach side 10, tip 70 sequentially contacts and slides over the sloped surfaces 55 of teeth 64, 63, 62, 61, and 60. Spring 72 compresses when tooth 69 is downwardly displaced in the direction of arrow L. After tracking tip 70 passes over an edge 53, the compressed spring 72 displaces tip 70 upwardly against the next successive sloped surface 55 of a tooth 64, 63, 62, 61. Spring 72 upwardly displaces tip 70 against rack 28 such that the movement of sliding door 18 in the direction of arrow O is prevented because tip 79 contacts a surface 64 of one of the rack teeth 60 to 64. The door 18 can only be moved in the direction of arrow O can only be accomplished if handle 67 is rotated in the direction of arrow K to downwardly displace tooth 69 in the direction of arrow L to disengage tip 70 from the teeth in rack 28. After handle 67 is rotated in the direction of arrow K and released, spring 72 upwardly displaces cable 66 and tooth 69 in the direction of arrow M to return handle 67 to the normal resting position illustrated in FIG. 7.

As illustrated in FIG. 3, vent holes 24 and 25 preferably are spaced apart and weight 50 preferably is sized such that the length of weight 50 is short enough to fit between vent holes 24 and 25 and one vent hole 24 can, while weight 50 travels from the top 35 to the bottom 34 of tube 23 and seal 46 is intermediate holes 24 and 25, allow air to flow in to tube 23 above weight 50 while the other vent hole permits air to flow out of tube 23 below weight 50.

Having described my invention in such terms as to enable those skilled in the art to make and use the invention and having described the presently preferred embodiments thereof, I claim:

1. A door closing device comprising (a) a vertically oriented hollow tube having a top and a bottom and first (24) and second (25) vent openings formed in said bottom, said vent openings being spaced a selected distance apart with said first opening positioned above said second opening;

(b) a weight disposed in said tube for movement along said top and said bottom, said weight having a length less than said selected distance between said vent openings such that said weight is unable to simultaneously extend over both of said vent openings while said weight travels up and down through said hollow tube;

(c) a seal connected to said weight for sealing the exterior of said weight and the interior of said housing;

(d) a pulley attached to the top of said tube;

(e) a cable attached to the top of said weight and extending over said pulley and attached to a selected point on the door header; and (f) spring means (33) mounted inside the top of said tube and spaced above said first vent opening to be contacted and compressed by said weight when said weight moves upwardly from said bottom over said first vent opening into the top of said tube, said weight being spaced apart from said spring means when said weight is in said bottom of said tube;

air being forced out of said tube through said first vent opening and drawn into said tube through said second vent opening when said weight is intermediate said first and second vent openings and moving upwardly through said tube, air being drawn into said tube through said first vent opening and being forced out of said tube through said second vent opening when said weight is intermediate said first and second vent openings and moving downwardly through said tube.

2. The door closing device of claim 1 including port means at said bottom of said tube to permit air to flow in or out of said tube below said weight, said port means being sized to permit air to flow out of said tube at a slower rate than said second vent opening (25) after said weight and seal have moved through said vertically oriented tube downwardly past said second vent opening (25) and are traveling downwardly toward said port means.

3. The door closing device of claim 1 wherein the distance between said first vent opening and said spring means is such that said weight is positioned intermediate said first vent opening and said pulley when said weight moves into the top of said tube and compresses said spring means.

4. A latch device for a sliding door having upper and lower horizontal frame members interconnected by vertical frame members and supported between a first upper track in the upper horizontal frame member and a lower track in the lower horizontal frame member opposed to said first upper track, said upper horizontal frame member including a second upper track parallel to and adjacent said first upper track, said door having a leading edge and inner and outer faces each terminating at said leading edge and each parallel to the directions of travel of said door along said first upper track and lower track, said latch device comprising (a) an elongate rack of downwardly projecting teeth attached to said second upper track, each tooth including a sloped planar surface and a vertically oriented surface co-terminating at the tip of the tooth;

(b) a housing fixedly attached to the top of said outer face of said door;

(c) a tracking tooth slidably mounted in said housing and spaced away from said door and including a tracking tip;

(d) biasing means (72) mounted in said housing for upwardly urging said tracking tooth toward said second upper track such that (i) said tracking tooth slides over at least a portion of said sloped planar surface and said tip of at least one of said rack teeth when said door is being closed in a first direction of travel, and (ii) said tracking tip of said tracking tooth is prevented by said vertically oriented surface of said one of said rack teeth from moving in a direction opposite said first direction of travel after the door is closed;

said housing including a first member (68) fixedly attached to said outer face of said door;

a second member (67) slidably mounted in said housing and carrying said biasing means and said tracking tooth;

spring-loaded control means (72, 66) for moving said second member in said fixed first member between at least two operative positions, a first operative position with said tracking tip of said tracking tooth at an elevation sufficient to engage said rack teeth, and a second operative position with said second member, said biasing means, said tracking tooth displaced from said first operative position such that said tracking tooth is at an elevation at which said tracking tip is prevented from engaging said rack teeth.

5. The latch device of claim 4 wherein said spring-loaded control means includes spring means extending from said first member (68, 87) to said second member (67, 91) to displace said second member upwardly toward said rack of teeth and normally maintain said second member in said first operative position.

6. The latch device of claim 5 wherein said spring-loaded control means includes a pivotal handle (67) attached to said door and to said second member to move said second member from said first to said second operative position by slidably downwardly displacing said second member to compress said spring means.

7. A latch device for a door, said latch device comprising (a) an elongate rack of downwardly projecting teeth attached to a selected point on the door header, each tooth including a sloped planar surface and a vertically oriented surface co-terminating at the tip of the tooth;

(b) a housing fixedly attached to the top of the door;

(c) a tracking tooth slidably mounted in said housing and including a tracking tip;

(d) biasing means (72) mounted in said housing and contacting said tracking tooth to upwardly urge said tracking tooth toward the door header such that (i) said tracking tooth slides over at least a portion of said sloped planar surface and said tip of at least one of said rack teeth when said door is being closed in a first direction of travel, and (ii) said tracking tip of said tracking tooth is prevented by said vertically oriented surface of said one of said rack teeth from moving in a direction opposite said first direction of travel after the door is closed;

said housing including a first member (68) fixedly attached to said door;

a second member (67) slidably mounted in said housing and carrying said biasing means and said tracking tooth, and spring-loaded control means (72, 66) for moving said second member between at least two operative positions, a first operative position with said tracking tip of said tracking tooth at an elevation sufficient to engage said rack teeth, and a second operative position with said second member, said biasing means, said tracking tooth displaced from said first operative position such that said tracking tooth is at an elevation at which said tracking tip is prevented from engaging said rack teeth.

8. The latch device of claim 7 wherein said spring-loaded control means includes spring means (72A) extending from said first member (68, 87) to said second member (67, 91) to displace said second member upwardly toward said rack of teeth and maintain said second member in said first operative position.

9. The latch device of claim 8 wherein said spring-loaded control means includes a pivotal handle (67) attached to said door and to said second member to move said second member from said first to said second operative position by slidably downwardly displacing said second member to further compress said spring means.

* * * * *